United States Patent [19]

Iino et al.

[11] Patent Number: 4,493,610

[45] Date of Patent: Jan. 15, 1985

[54] AXIAL THRUST BALANCING SYSTEM

[75] Inventors: Toshiki Iino, Ibaraki; Hiromi Kaneko, Mitsukaido; Michiyuki Takagi, Ibaraki; Kazuhiro Komatsu, Tokyo, all of Japan

[73] Assignee: Hitachi, Ltd., Tokyo, Japan

[21] Appl. No.: 436,715

[22] Filed: Oct. 26, 1982

[30] Foreign Application Priority Data

Oct. 28, 1981 [JP] Japan ..... 56-171431

[51] Int. Cl.[3] ..... F01D 3/04

[52] U.S. Cl. ..... 415/104; 415/170 B; 384/111

[58] Field of Search ..... 415/104–107, 415/170 B, 170 R, 170 A; 308/DIG. 5; 384/107, 111, 121, 303, 305; 416/174, 500

[56] References Cited

U.S. PATENT DOCUMENTS

| | | | |
|---|---|---|---|
| 1,499,056 | 6/1924 | Hollander | 415/104 |
| 3,861,825 | 1/1975 | Blom | 415/104 X |

FOREIGN PATENT DOCUMENTS

| | | | |
|---|---|---|---|
| 1528717 | 10/1969 | Fed. Rep. of Germany | 415/104 |
| 2700471 | 7/1978 | Fed. Rep. of Germany | 415/104 |
| 60646 | 10/1921 | Sweden | 415/104 |

*Primary Examiner*—Robert E. Garrett
*Assistant Examiner*—Joseph M. Pitko
*Attorney, Agent, or Firm*—Antonelli, Terry & Wands

[57] ABSTRACT

An axial thrust balancing system including a sleeve for balancing an axial thrust applied to a rotary shaft and a bush defining therebetween a clearance having arranged therein at least one pressure chamber for dividing the clearance into a plurality of smaller clearances. The axial division of the clearance reduced the ratio of the axial length of the clearance to the diameter of the sleeve and stabilizes the bearing characteristics of a film of fluid in the clearance, thereby inhibiting the generation of a self-excited vibration of the shaft up to a high rotation velocity.

1 Claim, 9 Drawing Figures

AXIAL THRUST BALANCING SYSTEM

BACKGROUND OF THE INVENTION

This invention relates to an axial thrust balancing system suitable for use with a multi-stage centrifugal pump, multi-stage centrifugal compressor, etc.

One type of axial thrust balancing system known in the art comprises a sleeve mounted on a rotary shaft for balancing axial thrust, a bush separated from the sleeve by a small annular clearance, a high pressure balance chamber interposed between the sleeve and the back of an impeller, and a low pressure balance chamber located on a side of the sleeve opposite the side on which an impeller is located.

In this construction, the majority of the fluid drawn by suction through a suction port of the impeller and discharged from the impeller through a discharge port is supplied through an outlet casing to a predetermined position. Part of the discharge fluid flows into the high pressure balancing chamber located behind the impeller and through the clearance and the low pressure balance chamber to be led to the suction side of a pump or released to the atmosphere.

In the aforesaid axial thrust balancing system, the discharge pressure and the suction pressure of the pump act, for example, on side walls of the sleeve adjacent the high pressure balance chamber and low pressure balance chamber, so that the axial thrust acting in the direction of the suction port of the impeller can be mitigated by the sleeve.

In the aforesaid construction, a fluid filled in the clearance in the form of a thin film performs a sort of bearing function like a film of lubricant formed on a journal bearing. When the rotary shaft is rotated at an angular velocity which is higher than the natural angular frequency of the shafting, self-excited vibration of the shaft may occur as similar to the oil whip of the lubricated-journal bearing.

SUMMARY OF THE INVENTION

This invention has been developed for the purpose of obviating the problem of the prior art described hereinabove. Accordingly the invention has as its object the provision of an axial thrust balancing system capable of stabilizing the bearing characteristics of a film of fluid formed in the clearance between the sleeve and the bush to thereby prevent the occurrence of self-excited vibration of the shaft up to a high rotational velocity.

According to the invention, there is provided an axial thrust balancing system comprising a rotary shaft having an impeller mounted thereon, sleeve secured to the rotary shaft on the discharge side of the impeller for idle movement in an axial direction together with the rotary shaft, a bush attached to a casing enclosing the sleeve and juxtaposed against the sleeve, an annular clearance defined between the sleeve and the bush, a high pressure balance chamber and a low pressure balance chamber formed by the formation of the clearance on a side of the sleeve adjacent the impeller and on a side thereof opposite the side on which the impeller is located, respectively, and at least one pressure chamber located in the annular clearance for dividing it axially into a plurality of shorter annular clearances.

Additional and other objects, features and advantages of the invention will become apparent from the description set forth hereinafter when considered in conjunction with the accompanying drawings.

DESCRIPTION OF THE PREFERRED EMBODIMENTS

Figure 1:
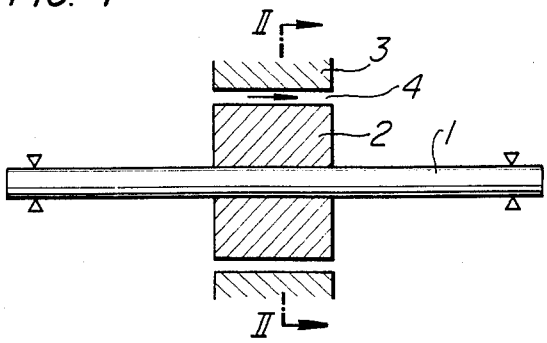
FIG. 1 is a schematic sectional view for explaining the principle of the axial thrust balancing system according to the invention.
Figure 2:
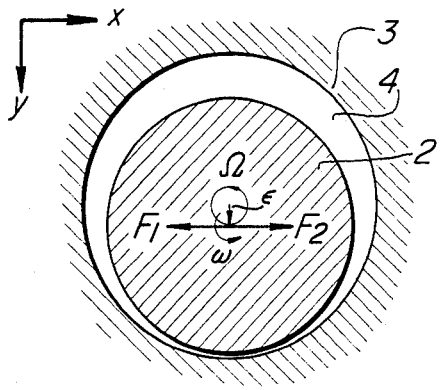
FIG. 2 is a schematic sectional view taken along the line II—II in FIG. 1.

As shown in FIG. 1, in order to enable a stable rotation of a shaft, a rotary shaft 1 has a sleeve 2 mounted thereon for balancing axial thrust, with a bush 3 being attached to a casing, and an annular clearance 4 being defined between the sleeve 2 and the bush 3. FIG. 2 shows balancing of forces, in the direction of swirling velocity occurring when the sleeve 2 moves in swirling movement on a circular orbit of a minuscule radius $\epsilon$ at an angular frequency of $\Omega$. The force $F_1$ is a force tending to increase the radius $\epsilon$ of the swirling movement by the coupled spring coefficient $K_{xy}$ of the fluid film, and the force $F_2$ is a force tending to decrease the radius $\epsilon$ of the swirling movement by the damping coefficient $C_{xx}$ of the fluid film. The condition of the swirling movement described above being damped with time can be expressed by the following formula:

$$F_2 > F_1 \tag{1}$$

$F_1$ and $F_2$ can be expressed by the following equations:

$$F_1 = K_{xy}\epsilon \tag{2}$$

$$F_2 = C_{xx}\epsilon\Omega \tag{3}$$

By substituting the equations (2) and (3) into formula (1), the following formula (4) can be obtained:

$$C_{xx}\Omega > K_{xy} \tag{4}$$

Formula (3) can be transformed by using the rotation angular velocity $\omega$ of the shaft 1 into the following formula (5):

$$\omega C_{xx}/K_{xy} > \omega/\Omega \tag{5}$$

Figure 3:
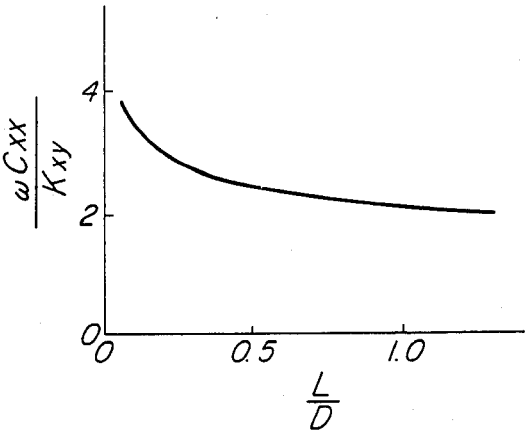
FIG. 3 is a diagrammatic representation of the whirling characteristic of a shafting.

Experiments were conducted on the spring coefficient and the damping coefficient of the film of fluid in the annular clearance 4 between the sleeve 2 and the bush 3 with regard to various combinations of the axial length L of the clearance 4 and the diameter D of the sleeve 2. The results of the experiments show that the left side $\omega C_{xx}/K_{xy}$ of formula (5) shows a change as shown in FIG. 3 as the ratio of the axial length to the diameter L/D is varied. In this figure, it will be seen that $\omega C_{xx}/K_{xy}$ shows a sudden increase if L/D is decreased, to enable the shaft 1 to rotate stably up to a high rotational velocity.

The diameter D of the sleeve 2 is set at a value necessary for balancing the axial thrust of the pump. Thus, to reduce the value of L/D, it is necessary to decrease the value of L as compared with that of the prior art. However, the fluid leaking through the clearance 4 would increase in flow rate and the pumping efficiency would be reduced if the value of L is merely decreased. This problem is obviated, if a plurality of sleeves of a small length L are provided to keep the flow rate of fluid leaks from increasing.

However, the use of a plurality of sleeves poses another problem with regard to cost. More particularly, the use of a plurality of sleeves together with a plurality of bushes would result in an increase in cost. However, if a pressure chamber of a large area is provided to one of the sleeve and the bush or to both of them in straddling relation, the effects achieved thereby would be the same as the effects achieved by the provision of a plurality of sleeves and bushes of small L/D. It has been ascertained by experiments that the effects achieved are not satisfactory unless the pressure chamber has an axial length which is over thirty-eight times as great as the size or radial width (i.e. size C in FIG. 4) of the clearance 4.

The axial length and the depth necessary for the pressure chamber to effectively divide the clearance 4 by the pressure chamber can be calculated as presently to be described by regarding the flow in the pressure chamber as a two-dimensional jet stream.

Figure 4:
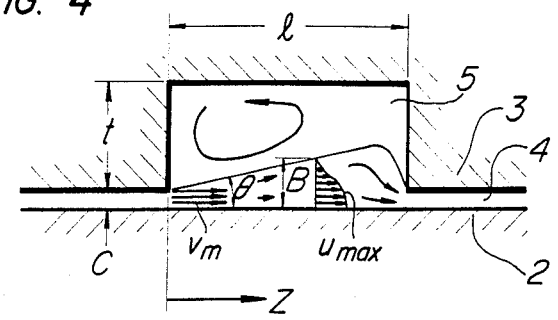
FIG. 4 is a diagram showing the manner in which flow of the fluid takes place in the pressure chamber in the clearance according to the invention.
Figure 5:
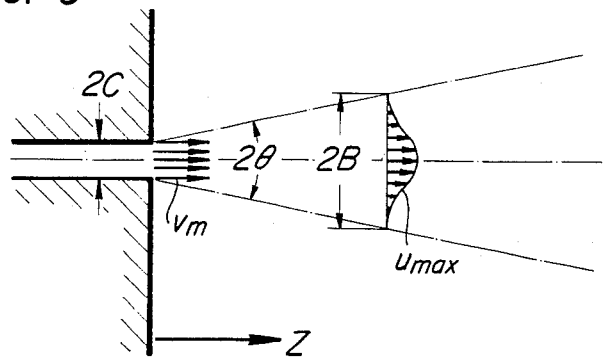
FIG. 5 is a schematic view showing the condition of a two-dimensional jet stream corresponding to the condition shown in FIG. 4.

FIG. 4 shows a condition of flow of the fluid in a pressure chamber 5 formed on an inner peripheral surface of the bush 3, in which l denotes the axial length of the pressure chamber 5, t the depth thereof and C the size of the annular gap or clearance 4. FIG. 5 shows a condition of a jet stream of two-dimensional shape in which 2C denotes the width of the jet stream at the ejection port, 2B the width of the jet stream in a cross section axially remote from the ejection port by a distance x and $u_{max}$ the maximum velocity of the jet stream in the central portion thereof. A momentum of the fluid flowing through one cross section of the stream should be constant regardless of the distance Z. Thus the following relation holds between the width 2B of the jet stream and the maximum velocity $u_{max}$:

$$u_{max}^2 2B = \text{constant} \tag{6}$$

Meanwhile when the jet stream is two-dimensional, the width 2B increases in proportion to the distance Z, so that a diverging angle $2\theta$ is constant without regard to the distance Z. Thus, the following relationship holds if streams around the ejection port are ignored:

$$2B = 2C + 2Z \tan\theta \tag{7}$$

When the jet stream is two-dimensional, the diverging angle $2\theta$ is about 12 degrees. The flow of the fluid in the pressure chamber 5 shown in FIG. 4 may be analyzed by regarding the same as an upper half portion of the two-dimensional jet stream shown in FIG. 5, in the same manner as the two-dimensional jet stream has described hereinabove. It will be seen that the relationship of equations (6) and (7) also hold with respect to the flow in the pressure chamber 5. If the maximum velocity $u_{max}$ is $v_m$ at an inlet (Z=0) of the pressure chamber 5, the width B of the jet stream, the maximum velocity $u_{max}$ thereof can be expressed by the following equations (Note that the diverging angle $\theta$ of the jet stream is about 6 degrees.):

$$B = C\left(\frac{Z}{C}\tan 6^\circ + 1\right) \tag{8}$$

$$u_{max} = \frac{V_m}{\sqrt{\frac{Z}{C}\tan 6^\circ + 1}} \tag{9}$$

With regard to the contribution of deceleration of the maximum velocity $u_{max}$ for obtaining effective functioning of the pressure chamber 5, the role of the pressure chamber 5 would be to separate one portion of the clearance on one side from the other portion thereof on the other side so as to keep the portion of the clearance on the upstream side from influencing the portion thereof on the downstream side. Stated differently, the pressure chamber 5 functions in such a manner that a dynamic pressure $v_{m2}/2$ g of an axial flow at the inlet of the pressure chamber 5 is satisfactorily reduced within the pressure chamber 5 and the peripheral distribution of pressures existing at the inlet of the pressure chamber 5 is eliminated within the pressure chamber 5. The end of reducing the peripheral distribution of pressures existing at the inlet of the pressure chamber 5 can be attained by satisfactorily reducing the dynamic pressure of the axial flow within the pressure chamber 5.

Taking the total pressure differential in an axial direction of the sleeve 2 as a reference, the function of the pressure chamber 5 would be considered satisfactorily performed if the dynamic pressure $u^2_{max}/2$ g can be reduced to less than 1% of the total pressure differential within the pressure chamber 5. Generally the dynamic pressure $v_{m2}/2$ g of an axial flow in the clearance between the sleeve 2 and the bush 3 is about 5% of the total pressure differential. Thus, one has only to decelerate the flow of the fluid in such a manner that the dynamic pressure is reduced to about 1/5 thereof. In other words, the condition of $$u_{max} = \frac{1}{\sqrt{5}} v_m$$

would have only to be created in the pressure chamber 5. The axial length l of the pressure chamber 5 necessary for this purpose is as follows from equation (9):

$$l \geqq 38C \tag{10}$$

The depth t of the pressure chamber 5 is required to be greater than the maximum width of the jet stream therein, so that the depth t is as follows from equation (8):

$$t \geqq 0.1l \tag{11}$$

Figure 6:
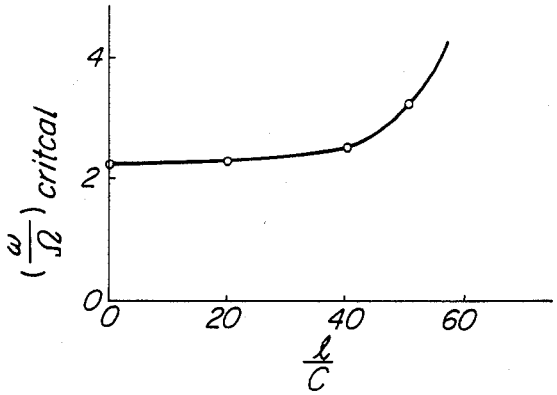
FIG. 6 is a diagrammatic representation of the self-excited vibration generation limits characteristic of a shaft.

FIG. 6 shows the critical rotational velocity value ($\omega/\Omega$) as measured actually, which causes the self-excited vibration of a shaft in the system 4 in which the ratio of the axial length L of the clearance 4 to the diameter of the sleeve 2 is about 1.0 and the clearance 4 is divided by three pressure chambers into four portions. In the figure, it will be seen that if the dimensionless axial length l/C of the pressure chamber is over thirty-eight times as great, the shafting is suddenly stabilized, thereby providing that equation (10) is appropriate.

Figure 7:
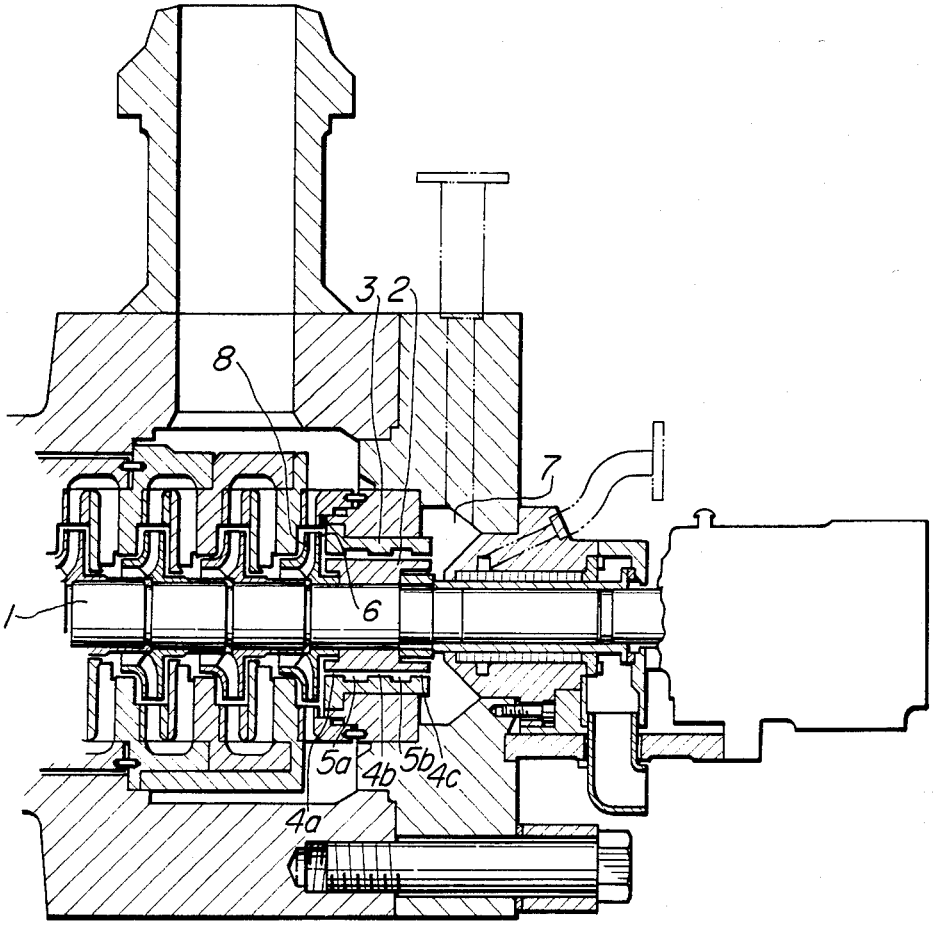
FIG. 7 is a sectional view of the essential portions of the axial thrust balancing system according to an embodiment of the invention.

Referring to FIG. 7, a rotary shaft 1 has an impeller 8 secured thereto which has a sleeve 2 mounted at its back for balancing axial thrust. A bush 3 is located adjacent an outer peripheral surface of the sleeve 2 with annular clearances 4*a*, 4*b* and 4*c* being interposed therebetween. The bush 3 is formed at its inner peripheral surface with a plurality of (two in this embodiment) pressure chambers 5*a* and 5*b*. A high pressure balance chamber 6 is located between the sleeve 2 and the back of the impeller 8, and a low pressure balance chamber 7 is located on a side of the sleeve 2 opposite the side thereof adjacent the impeller 8.

Part of the fluid discharged from the impeller 8 is led into the high pressure balance chamber 6 at the back of the impeller 8 and flows through the clearance 4*a*, pressure chamber 5*a*, clearance 4*b*, pressure chamber 5*b* and clearance 4*c* into the low pressure balance chamber 7, before being introduced into the suction side of the pump or released to the atmosphere. The pressure chambers 5*a* and 5*b* are sufficiently large in volume to render the bearing action of the fluid filled in the clearances 4*a*–4*c* equal to the sum of the bearing actions of the clearances 4*a*–4*c*. The clearances 4*a*–4*c* are constructed such that the ratio L/D is sufficiently low to obtain stability in the rotation of the shaft up to a high rotation angular velocity, as described by referring to FIG. 3.

In the embodiment shown and described hereinabove, the clearance is divided into the three clearances 4*a*–4*c* by the two pressure chambers 5*a* and 5*b*. It is to be understood, however, that the invention is not limited to this specific number of clearances. In some cases, it is better to divide the clearance 4 into over four clearances and in some cases two clearances are enough, to give a suitable value to the ratio L/D.

Figure 8:
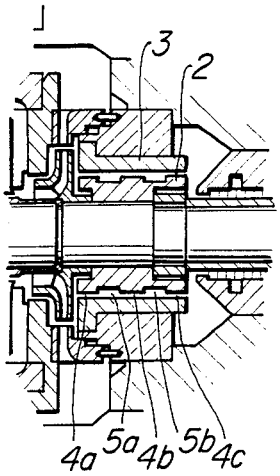
FIGS. 8 and 9 are sectional views of the essential portions of the axial thrust balancing system according to other embodiments.
Figure 9:
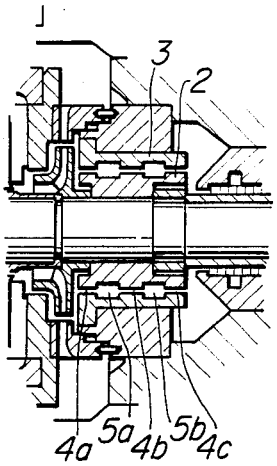

In the embodiment described hereinabove, the two pressure chambers 5*a* and 5*b* are located on the side of the bush 3. The invention is not limited to this specific arrangement of the pressure chambers 5*a* and 5*b*, and the same effects can be achieved by arranging the pressure chambers 5*a* and 5*b* on the sleeve 2 side as shown in FIG. 8 and by arranging them in a manner to straddle the sleeve 2 and the bush 3 as shown in FIG. 9.

From the foregoing description, it will be appreciated that in the axial thrust balancing system according to the invention, the clearance between the sleeve and the bush is divided by a pressure chamber or chambers into a plurality of clearances to reduce the value of the ratio of the axial length L of the clearance to the diameter D of the sleeve. This arrangement is conducive to stabilization of the bearing characteristics of a film of fluid in the clearance, so that the pump can be operated stably without giving rise to a self-excited vibration of its shaft up to a high rotation velocity.

What is claimed is:

1. An axial thrust balancing system comprising a rotary shaft having an impeller mounted thereon, a sleeve secured to said rotary shaft on the discharge side of said impeller for rotation with the rotary shaft, a bush attached to a casing enclosing the sleeve and juxtaposed against the sleeve, an annular clearance defined between said sleeve and said bush, and at least one annular pressure chamber formed in a surface of at least one of the sleeve and the bush for dividing the clearance axially into a plurality of shorter clearances, said annular pressure chamber having an axial length over thirty-eight times as great as a radial width of said clearance and a depth of over 0.1 times as great as the axial length of the annular pressure chamber.

* * * * *